United States Patent [19]

Owens

[11] 4,340,351

[45] Jul. 20, 1982

[54] VIBRATORY CONCRETE SCREED WITH ECCENTRIC DRIVE SHAFT

[76] Inventor: Joe M. Owens, 16 Pebblewood Trail, Naperville, Ill. 60540

[21] Appl. No.: 234,348

[22] Filed: Feb. 13, 1981

[51] Int. Cl.[3] ..... B28B 1/08; E01C 19/22; E01C 19/30; B06B 1/16

[52] U.S. Cl. ..... 425/456; 264/69; 404/118; 404/120

[58] Field of Search ..... 425/456; 404/118, 119, 404/120; 264/69

[56] References Cited

U.S. PATENT DOCUMENTS

| | | | |
|---|---|---|---|
| 3,164,072 | 1/1965 | Blankenship et al. | 404/120 X |
| 3,435,740 | 4/1969 | McGall | 404/119 X |
| 4,030,873 | 6/1977 | Morrison | 425/456 |
| 4,213,749 | 7/1980 | Morrison | 425/456 |
| 4,261,694 | 4/1981 | Morrison | 425/456 |

*Primary Examiner*—Philip E. Anderson
*Attorney, Agent, or Firm*—Howard H. Darbo

[57] ABSTRACT

A light-weight, portable and sturdy vibratory concrete screed which may be fabricated in modular fashion from a plurality of interconnected, separable frame units. A framework is provided, having a series of spaced, parallel unitary frame members of triangular configuration, the corners of the base of each frame member being attached to a pair of screed plates and maintaining the screed plates in spaced-apart relationship. Side braces and base braces extend between adjacent frame members for framework rigidity. An eccentric shaft is supported for rotation in bearings mounted in the frame members. The shaft may be symmetrically located in order to impart uniform vibrations to the two screed plates, or may be offset in order to self-propel the concrete screed.

14 Claims, 11 Drawing Figures

VIBRATORY CONCRETE SCREED WITH ECCENTRIC DRIVE SHAFT

BACKGROUND OF THE INVENTION

This invention relates to vibratory concrete screeds and in particular to a portable screed of minimum weight and optimal strength and stiffness which may be joined in a series of interconnected frame units to impart uniform vibrations to poured concrete for tamping and leveling of the concrete as it is finished.

As labor costs continue to escalate, it is becoming increasingly important to accomplish a labor-intensive task in the least possible time in order to incur the least possible labor expenses. To this end, and in particular with regard to finishing of concrete, various screeds have been developed in order to substantially reduce the period of time necessary to finish the concrete, yet at the same time enhance the surface appearance of the concrete.

One such screed is described in U.S. Pat. No. 4,030,873. This patent discloses a concrete screed having an open, truss-like framework which includes a central shaft which is flexible and which is loosely supported for rotation in bearings situated periodically along the length of the screed. A series of frame units can be joined to form an elongate screed for finishing of relatively wide expanses of poured concrete. Another type of screed, using compressed air to impart vibrations to the screed plates, is sold by the H. Compton Co., Conroe, Texas 77301. Like that disclosed in above-identified U.S. Pat. No. 4,030,873, the Compton screed is truss-like and may be assembled in a series of modular sections. A similar concrete screed is also manufactured by A.W.S. Manufacturing Inc., the assignee of the present invention.

SUMMARY OF THE INVENTION

The present invention improves upon prior art concrete screeds by introducing a new, light-weight alloy frame which provides optimal stiffness and strength for the concrete screed, while allowing the flexibility to smooth concrete surfaces which are other than level.

As prior art concrete screeds, the present invention includes a pair of spaced-apart, elongate screed plates for working concrete as the screed is moved across the concrete. The invention also includes vibratory means to impart uniform vibrations to the screed plates for tamping and leveling the concrete during the finishing process.

The framework of the invention uniquely consists of a series of spaced, parallel unitary frame members of triangular configuration, each of the corners of the base of each frame member being attached to the screed plates for maintaining the screed plates in spaced-apart relationship. A plurality of side braces extend between the frame members, each side brace extending between the base of one frame member and the apex of the next adjacent frame member.

For additional strength, the screed can include a plurality of base braces, each base brace extending between the corner of the base of one frame member proximate one of the screed plates to the corner of the base of the next adjacent frame member proximate the other of the screed plates. A ridge plate is typically attached to the apex of each of the frame members for added rigidity.

The vibratory means includes a driven, elongated, eccentric shaft which passes through a central aperture in each of the frame members. To support the shaft and to permit shaft vibrations to be imparted to the screed plates, at least two of the frame members of each frame unit include bearings fixed in the frame member, the shaft being journalled for rotation within the bearings.

The eccentric shaft comprises a substantially uniform shaft having a series of complementary, eccentric weights affixed thereto in alignment along the length of the shaft, preferably on opposite sides of each bearing. The shaft is driven by a motor mounted on the framework.

Each of the triangular frame members is cast from a lightweight alloy and includes a rigid cross support to impart added strength to the frame members and to provide a path through which vibration of the eccentric shaft may be transmitted directly to the screed plates. If self-propulsion of the screed is desired, the cross-member can be formed such that the eccentric shaft is mounted in a bearing closer to one of the screed plates than the other. This causes an imbalance of the screed in the direction toward which the shaft is mounted.

One or both of the screed plates, and in particular that which is the forward screed plate in the direction of travel, may include a concave face to enhance the grading and smoothing of the concrete. The concavity of the face tends to cut into areas of excessive concrete rather than traveling thereover.

Preferably, the framework is provided in a series of modular sections of separable, elongate frame units. Each of the frame units can be releasably interconnected at its end with another frame unit, thus allowing a series of frame units to be joined in modular fashion to form an elongated screed of a desired length. The interconnecting means for the modular frame units is adjustable in order to vary the angular relationship between the frame units so that concave or convex structures may be formed to crown or swale the poured concrete.

BRIEF DESCRIPTION OF THE DRAWINGS

The invention is set forth in greater detail in a following description of the preferred embodiments, taken in conjunction with the drawings, in which:

FIG. 4 is an isometric assembly view of a modular concrete screed frame unit according to the invention, showing means for interconnecting adjacent frame units and illustrating the motor for rotating the eccentric shaft.

DESCRIPTION OF THE PREFERRED EMBODIMENTS

Figure 1:
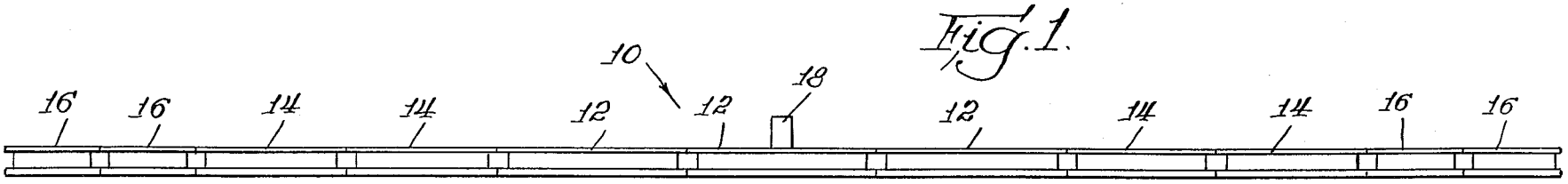
FIG. 1 schematically illustrates a concrete screed according to the invention formed of a series of modular frame units of varying length joined together in an elongate fashion.

The concrete screed according to the invention is schematically depicted at 10 in FIG. 1. Three frame units 12, 14 and 16, comprising interconnected modular frame units of three different lengths, are shown comprising the screed 10. A vibratory motor 18 is mounted for imparting uniform vibrations to the screed 10.

Figure 2:
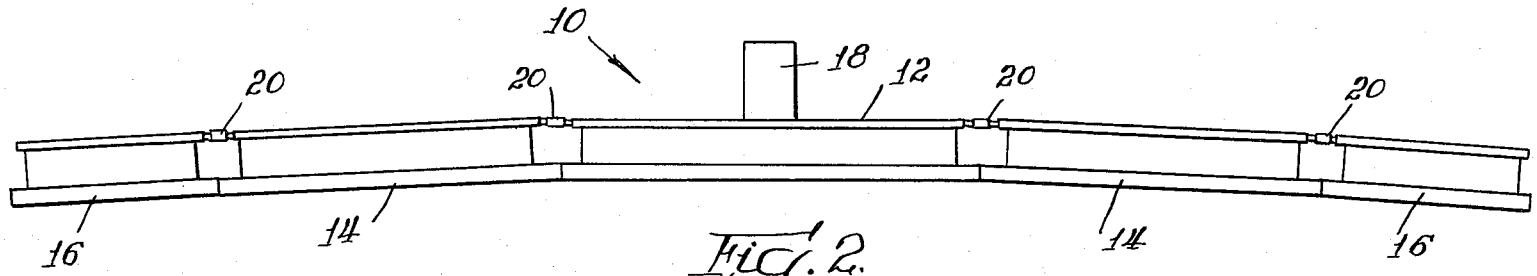
FIG. 2 is a schematic front elevational illustration similar to that shown in FIG. 1, but enlarged and showing adjustment of the innerconnected modular frame units to form a convex screed for crowning poured concrete.
Figure 3:
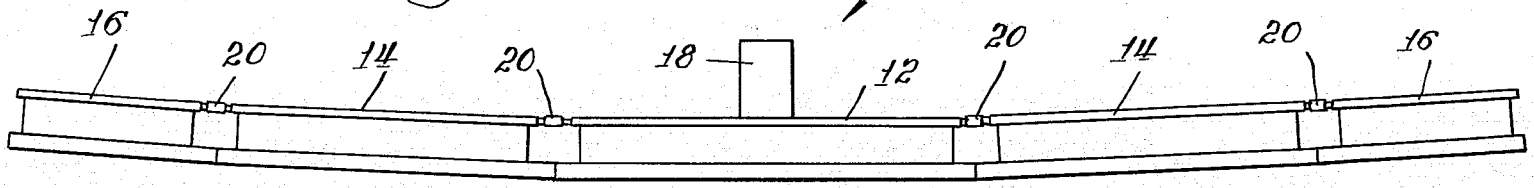
FIG. 3 is a front elevational illustration similar to FIG. 2, but with the modular frame units joined in a concave fashion in order to swale poured concrete.
Figure 1:
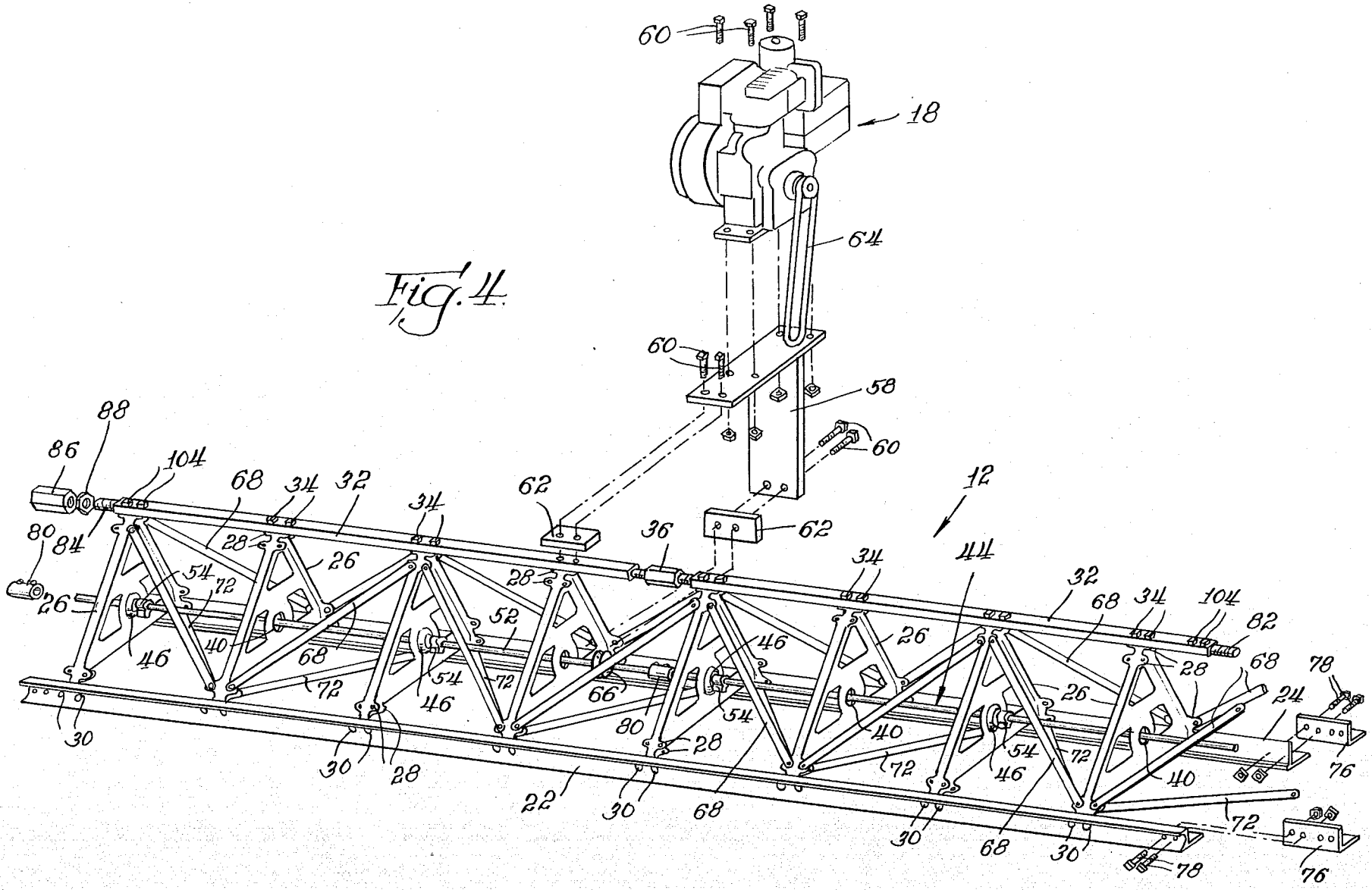

FIG. 2 shows in slightly enlarged form a series of frame units 12, 14 and 16 which have been connected to comprise a screed 10 and which have been interconnected by adjustment couplers 20 such that the screed 10 is bowed in a convex fashion to smooth poured concrete with a crown. FIG. 3 is similar to FIG. 2, but with the couplers 20 having been adjusted to form the screed 10 in a concave fashion in order to permit finishing of poured concrete with a swale. Couplers 20 are illustrated in greater detail in FIG. 10 and are described below in relation to FIG. 10.

FIG. 4 illustrates a single frame unit 12, 14 or 16 in detail. Since the frame units are modular, for the sake of description, that shown in FIG. 4 will be designated with the numeral 12, it being understood that the frame unit described is representative of any of the frame units 12, 14 or 16.

The frame unit 12 is composed of a pair of spaced-apart, elongate screed plates 22 and 24 for working concrete as the screed 10 is moved across poured concrete. A framework interconnects the screed plates 22 and 24, the framework having a series of spaced, parallel unitary frame members or A-frames 26 of triangular configuration. Preferably, the frame members 26 are cast as a unitary structure of a light weight aluminum/-magnesium alloy. It has been found that an alloy having eight percent magnesium provides optimal stiffness and strength, while allowing required flexibility of the screed.

Figure 7:
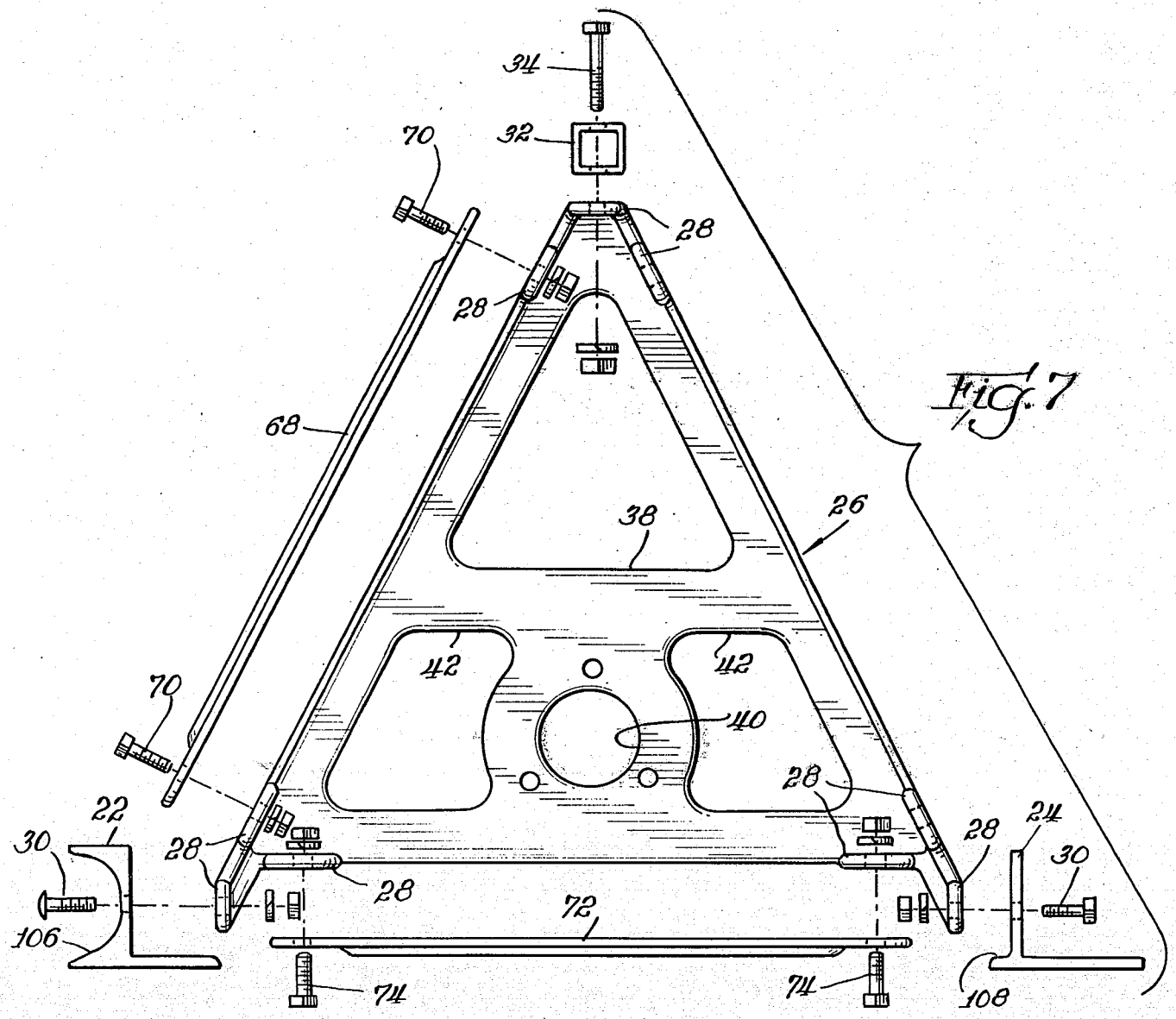
FIG. 7 is an enlarged side elevational assembly illustration of a frame member and its attachment to the screed plates and braces.

As illustrated in better detail in FIG. 7, the corners of the base of each frame member 26 are attached to the respective screed plates 22 and 24. For such attachment, the frame member 26 includes an integral bracket at each corner in the shape of a plurality of ears or flanges 28 which are situated in opposed pairs and which extend laterally from the frame member 26. A series of bolts 30 pass through aligned apertures in the screed plates 22 and 24 and the frame member 26 for securely affixing the frame member 26 to the screed plates 22 and 24.

A ridge plate 32, in the shape of a hollow box beam (FIG. 7), interconnects the apexes of each of the frame members 26. The ridge plate 32 is attached to flanges 28 of the frame members 26 by means of a series of bolts 34 passing through aligned apertures in the ridge plate 32 and the flanges 28.

To adjust the angular relationship between portions of the screed plates 22 and 24 on opposite halves of the frame unit 12, the ridge plate 32 may include an adjustable coupler 36 in a central location as illustrated. The coupler 36 is identical to the couplers 20, which are described in greater in connection with FIG. 10.

Each of the frame members 26 includes an integral, rigid cross support 38. As best shown again in FIG. 7, the cross support includes a central aperture 40 and, for the purposes of weight reduction, one or more cut-outs 42. The frame member 26 is symmetrical, as shown.

In the assembled frame unit 12, an eccentric shaft 44 passes through the apertures 40 of the aligned frame members 26, extending from one end of the frame unit 12 to the other. The eccentric shaft is journalled for rotation in a series of bearings 46 situated in the central apertures 40 of the frame members 46.

Figure 9:
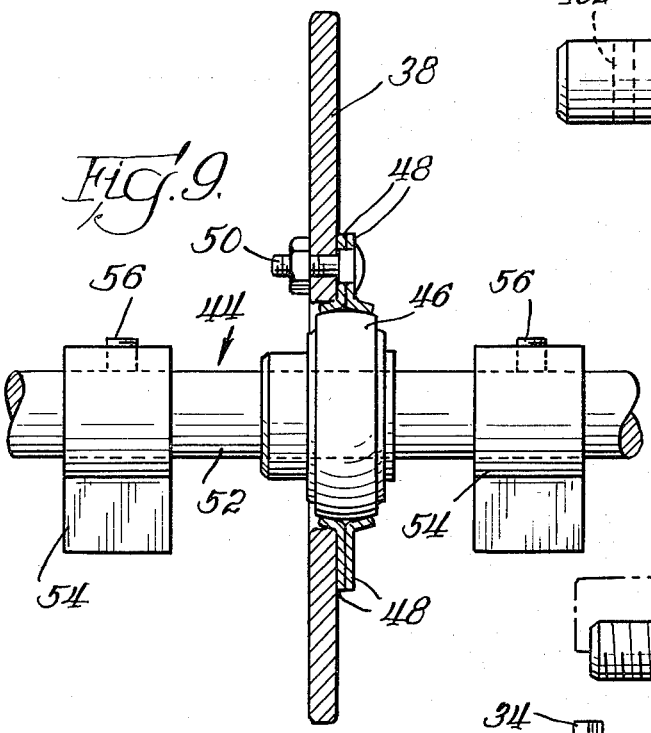
FIG. 9 is an enlarged, fragmentary illustration of the connection of the eccentric shaft to the cross support of a frame member, showing the eccentric weights being situated on opposite side of the cross support.

As best shown in FIG. 9, the bearing 46 is mounted in a pair of back-to-back bearing flanges 48 which are bolted to the cross supports 38 by a series of carriage bolts 50. The eccentric shaft 44 is mounted within the bearing 46 to close tolerances, so that vibration of the eccentric shaft 44 will be transmitted through the bearing 46 and bearing flanges 48 directly to the cross support 38, and thence through the frame members 26 to the screed plates 22 and 24.

Also as shown in FIG. 9, the eccentric shaft 44 is comprised of a substantially uniform shaft 52 having a series of complementary eccentric weights 54 secured thereto by means of set screws 56. Preferably, the eccentric weights 54 are situated in pairs, one weight 54 on either side of each bearing 46.

Returning again to FIG. 4, the motor 18 is mounted on a bracket 58 which is attached to the frame unit 12 by means of a series of bolts 60. In order to isolate vibration of the frame unit 12 from the motor 18, rubber cushions 62 are secured between the bracket 58 and frame unit 12. A belt 64 drivingly connects the motor 18 to a pulley 66 mounted on the eccentric shaft 44.

The frame unit 12 includes a plurality of side braces 68, each side brace 68 extending between the base of one frame member 26 to the apex of the next adjacent frame member 26. The braces 68 are secured by bolts 70 to the flanges 28 (FIG. 7). Similarly, the frame unit 12 includes a plurality of base braces 72, each base brace extending between the corner of the base of one frame member 26 proximate one of the screed plates 22 or 24 to the corner of the base of the next adjacent frame member 26 proximate the other of the screed plates 22 or 24. Again, the base braces 72 are secured to the flanges 28 by means of bolts 74 (FIG. 7).

Figure 5:
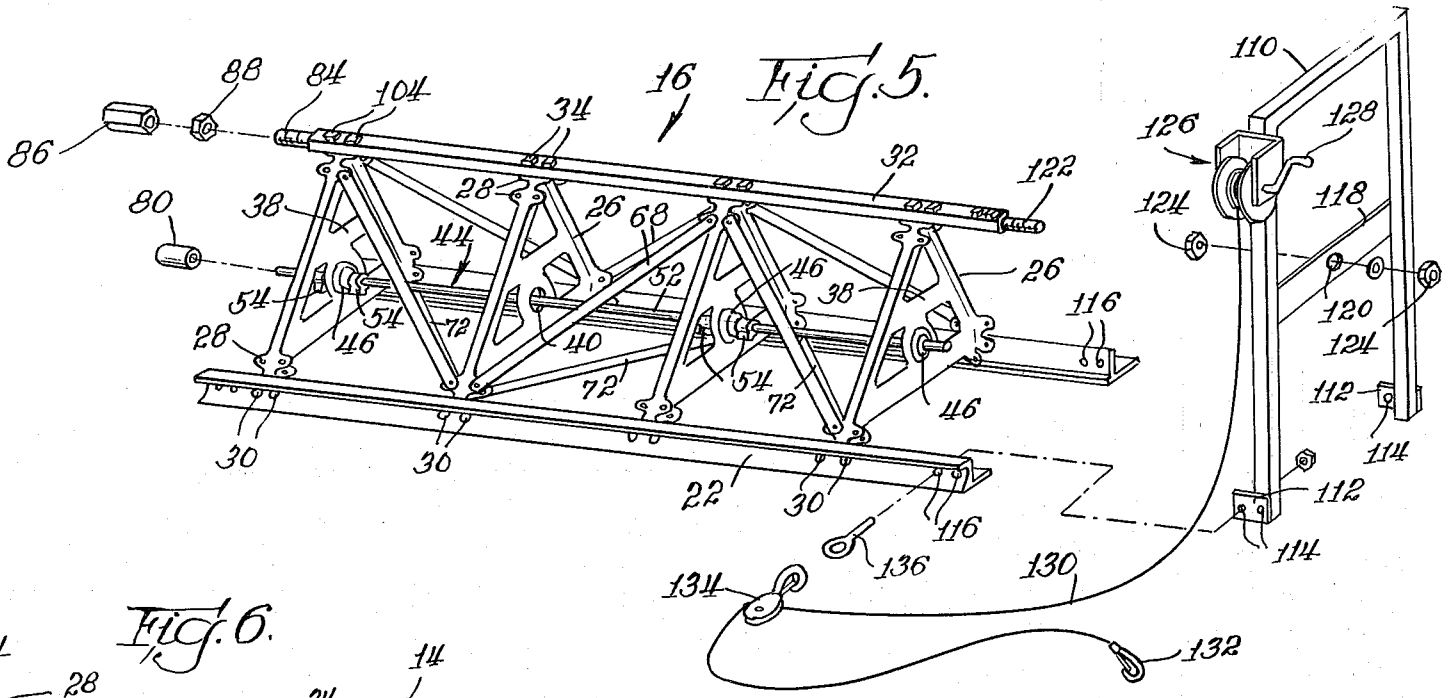
FIG. 5 is an isometric assembly illustration of an end frame unit of a series of modular screeds showing a device for manually driving the screed.
Figure 6:
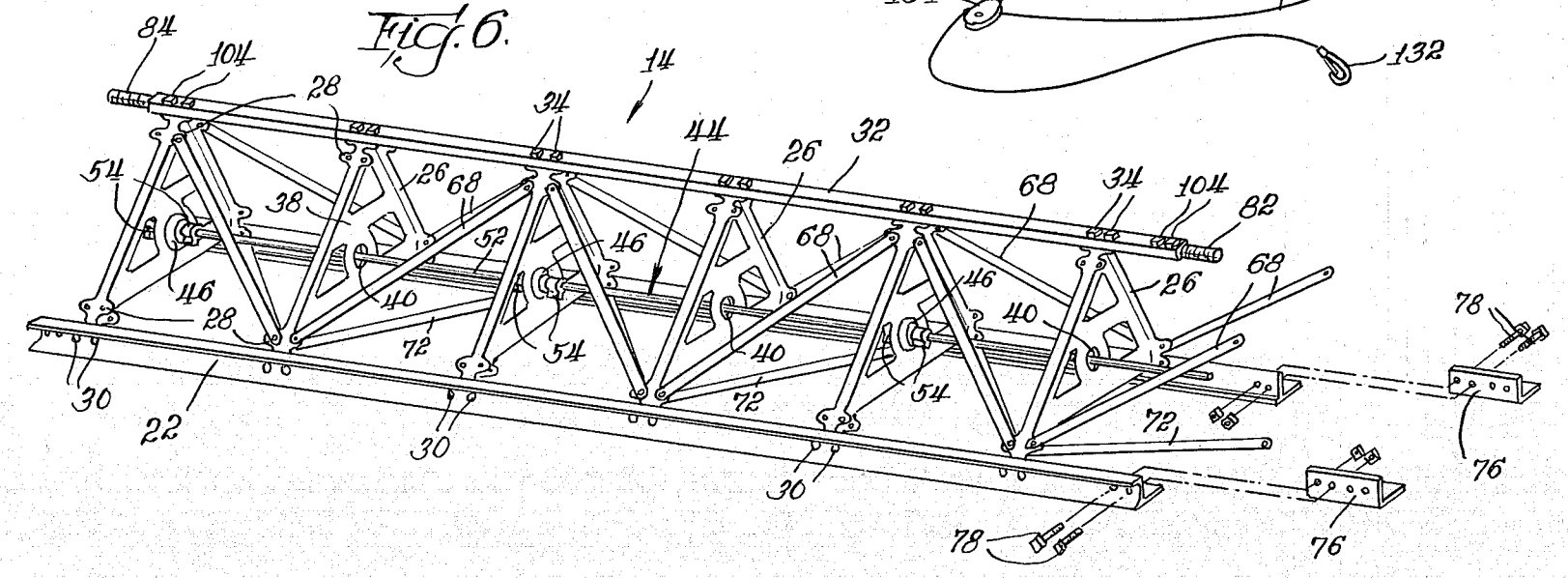
FIG. 6 is an isometric assembly illustration of a modular frame unit without a driving motor.
Figure 8:
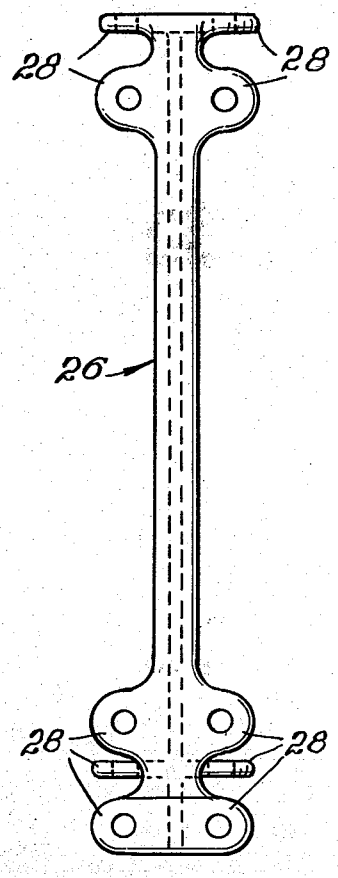
FIG. 8 is a side elevational illustration of one side of the frame member of FIG. 7, with the screed plates and braces removed for clarity.

FIGS. 5 and 6 illustrate additional frame units of shorter length than the frame unit 12 shown in FIG. 4. For the sake of description, the frame unit in FIG. 5 has been designated with the numeral 16, while that in FIG. 6 has been designated with the numeral 14. Again, however, the numeral designations are merely for the purposes of description, and are not intended to indicate a frame unit of any particular length. The frame units 14 and 16 of FIGS. 6 and 5 are substantially identical to the frame unit 12 illustrated in FIG. 4. Therefore, elements bearing common reference numerals will not be discussed further, it being understood that such elements have the same form and function as described in connection with the frame unit 12 of FIG. 4.

FIGS. 4 through 6 illustrate the means of coupling adjacent frame units. For interconnecting the screed plates 22 and 24 of coupled frame units, the invention includes angle brackets 76 which are drilled as illustrated to align with corresponding holes drilled in the respective screed plates 22 and 24. The brackets 76 are securely bolted to the screed plates 22 and 24 by a series of bolts 78 which pass through the aligned apertures in the respective screed plates 22, 24 and the angle brackets 76.

To drivingly interconnect the eccentric shafts 44 of the frame units 12, 14 and 16, a shaft coupler 80 is mated to each drive shaft of the adjoining frame units. The coupler 80 may be secured to the drive shafts by means of set screws (not illustrated) or any other suitable means for securely affixing the coupler 80 to the shafts 44.

Figure 10:
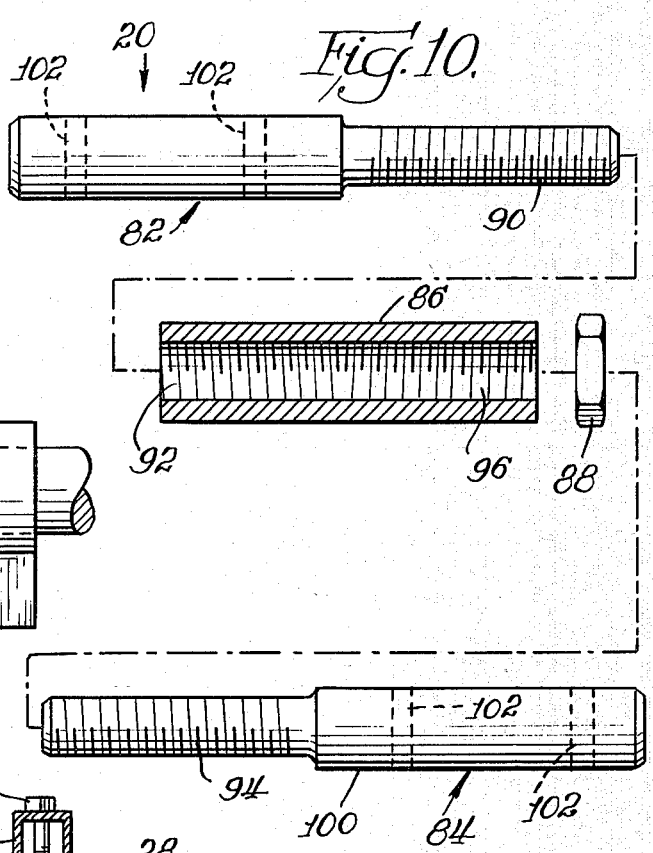
FIG. 10 is an enlarged, partial cross-sectional illustration of the adjustment means for joining the ridge plates of adjacent frame units and for providing the desired angular relationship between the screed plates of one frame unit relative to the screed plates of the adjacent unit.

The ridge plates 32 of adjoining frame units 12, 14 and 16 are joined by the adjustment couplers 20, best shown in FIG. 10. Each coupler 20 is composed of a pair of plugs 82 and 84 which threadedly engage a threaded coupler 86 and a lock nut 88. The plug 82 includes a threaded portion 90 having left-hand threads which engage corresponding left-hand threads 92 formed in the left-hand portion of the threaded coupler 86. Similarly, the plug 84 includes a threaded portion 94 having right-hand threads which engage corresponding right-hand threads in the lock nut 88 and in the right-hand portion 96 of the threaded coupler 86. The threading of the portions 90 and 94, and corresponding threaded portions 92 and 96 of the coupler 86 may be reversed, so long as the portions 90 and 94 carry opposed threading to facilitate the coupling and adjustment procedures, as outlined in greater detail below.

The shank 98 of the plug 82 is shaped to be inserted within the hollow interior of the ridge plate 32. Similarly, the shank 100 of the plug 84 is shaped also to be inserted within the hollow interior of the ridge plate 32. Each of the shanks 98 and 100 includes a pair of holes 102. When the plugs 82 and 84 are inserted within the ridge plate 32, the holes 102 are aligned with similar holes (not illustrated) drilled in the ridge plates 32, and the plugs 82 and 84 are secured to the ridge plates 32 by means of a plurality of bolts 104. Thus, the plugs 82 and 84 are removably inserted within the ridge plates 32 and may be omitted when unnecessary.

The screed plate 22 is designed to be that plate located at the forward side of the screed 10 as it is used to level poured concrete. Therefore, the screed plate 22 has the initial and primary task of leveling the untreated concrete surface. To aid in this task, and as best shown in FIG. 7, the screed plate 22 is shaped in a concave fashion at 106 so that the screed plate 22, in addition to leveling the concrete, also serves as a scoop to help remove excessive amounts of concrete. The excess concrete travels with the screed 10, and if an area of concrete is encountered which requires more concrete than that already poured, the additional concrete built up before the screed plate 22 will tend to supplement that already in place. Also, due to the concavity of the surface 106, the screed plate 22 will tend to cut into areas of excessive concrete rather than ride up and over those areas as would be the result if the face of the screed plate 22 were flat.

The screed plate 24 is formed in the shape of an angle iron, as best illustrated in FIG. 7. If desired, the screed plate 24 may include a leading leg 108 to aid the smoothing function of the screed plate 24 and remove any excessive deposits of concrete not removed by the screed plate 22.

The frame unit 16 of FIG. 5 is shown in connection with an end section 110. The end section 110 includes base plates 112 which are permanently affixed thereto and which have holes 114 which are drilled in alignment with corresponding holes 116 formed in the ends of the screed plates 22 and 24. The end section 110 therefore may be bolted (bolts not illustrated) to the screed plates 22 and 24.

The end section 110 also includes a cross brace 118 positioned at the altitude of the ridge plate 32. The cross brace 118 includes a central aperture 120. A plug 122, identical to the plug 82, may be inserted within the ridge plate 32 so that when the end section is affixed to the frame unit 16, the plug 122 will pass through the aperture 120 and can be attached to the cross brace 118 by the locking nuts 124.

The end section 110 also includes a winch 126 having a handle 128. The winch 126 is used for translating the screed 10 in a forward direction during the treating of poured concrete. The winch line 130 of the winch 126 includes a hook 132 which can be clipped to any suitable fixed object upstream from the traveling screed 10. The line 130 passes through a pulley 134 which is releasably clipped to an eye bolt 136 passing through one of the apertures 116 (and the aligned aperture 114) as shown. When the hook 132 is fixed to an immobile object, turning of the handle 128 will draw the screed across the poured concrete in the forward direction.

A screed 10 may be formed by one or any number of the frame units 12 through 16. Preferably, the motor 18 is mounted on the central frame unit for balancing of the screed. When more than one frame unit is employed, the frame units are joined by means of the angle brackets 76, shaft couplers 80, and adjustment couplers 20. First, the angle brackets 76 are bolted in place on the adjoining frame units. Then, a shaft coupler 80 is engaged on the two shafts 44 of the adjoining frame units, at the junction thereof, but is not affixed to the two shafts. Next, an adjustment coupler 20 is engaged between the ridge plates 32 of the two adjoining frame units and is adjusted to the degree desired in order to align the adjoining frame units in a planar fashion (FIG. 1) or convex fashion (FIG. 2) or concave fashion (FIG. 3). Then, as a final step, the shaft couplers 80 are clamped to the eccentric shafts 44 to complete driving interconnection between the adjoining frame units.

Figure 11:
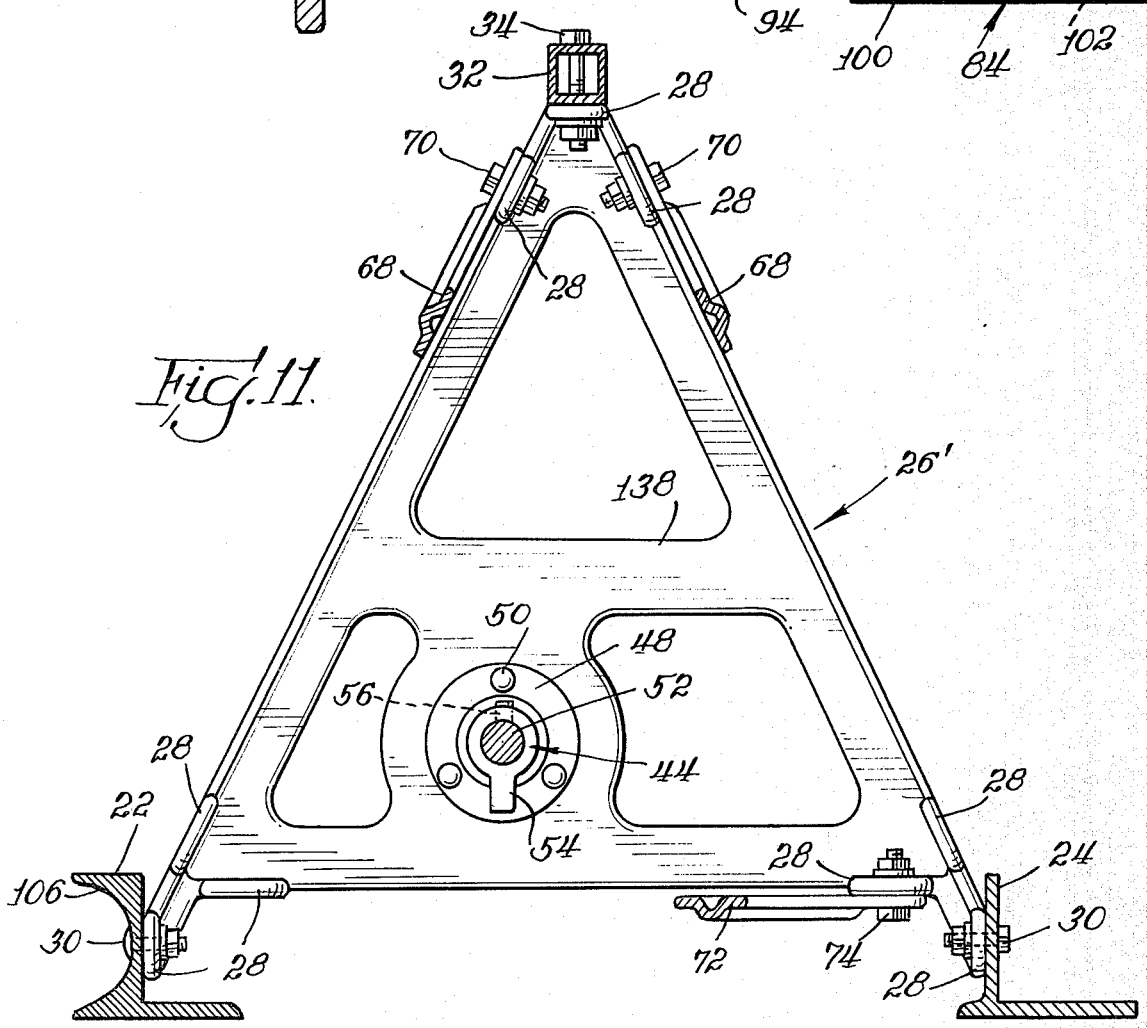
FIG. 11 is an elevational cross-sectional view of the invention showing an alternative embodiment in which the eccentric shaft is unsymmetrically mounted for self-propulsion of the concrete screed.

FIG. 11 illustrates an alternative embodiment of the invention for self-propulsion of the concrete screed. With the exception of a cross support 138 of the frame member 26', the remaining elements shown in FIG. 11 are identical to those discussed above and bear the same reference numerals. The descriptions for these elements will not be repeated.

The cross support 138 is asymmetrically shaped so that the eccentric shaft 44 is located closer to the screed plate 22 than the screed plate 24. The applicant has found that a maximum offset for the asymmetry of the cross support 138 from that shown with regard to the cross support 38 can be up to approximately half the distance from the center of the frame member 26 to the screed plate 22. Due to the asymmetry of the frame member 26', when the eccentric shaft 44 is driven by the motor 18, the unbalanced screed will tend to be self-propelled in the direction of the forward screed plate 22.

Various changes may be made to the invention without departing from the spirit thereof or scope of the following claims.

What is claimed is:

1. In a vibratory concrete screed having a pair of spaced apart elongate screed plates for working concrete as the screed is moved across the concrete and having vibratory means to impart uniform vibrations to the screed plates for tamping and leveling the concrete, the improvement comprising a. a framework interconnecting said screed plates, said framework having a series of spaced, parallel, unitary frame members of triangular configuration having an integral, rigid cross support, the corners of the base of each said frame member including means attaching said frame member to said screed plates and maintaining said screed plates in spaced apart relationship, and b. a plurality of side braces extending between said frame members, each side brace extending between the base of one said frame member and the apex of the next adjacent frame member.

2. A vibratory concrete screed according to claim 1 including a plurality of base braces, each base brace extending between the corner of the base of one frame member proximate one of said screed plates to the corner of the base of the next adjacent frame member proximate the other of said screed plates.

3. A vibratory concrete screed according to claim 1 including a ridge plate interconnecting and attached to the apex of each said frame member.

4. A vibratory concrete screed according to claim 1 in which said vibratory means includes a driven, elongate, eccentric shaft and in which each said frame member includes a central aperture for through passage of said shaft, at least two of said frame members including bearings fixed on said frame member, said shaft being journalled for rotation within said bearings.

5. A vibratory concrete screed according to claim 4 in which said eccentric shaft comprises a substantially uniform shaft having a series of complementary eccentric weights affixed thereto.

6. A vibratory concrete screed according to claim 4 including drive means carried by said framework for rotating said eccentric shaft.

7. A vibratory concrete screed according to claim 1 in which said vibratory means is connected to at least some of said cross supports for transmission of vibrations through said frame members directly to said screed plates.

8. A vibratory concrete screed according to claim 7 in which said vibratory means includes a driven, eccentric shaft connected to said cross supports closer to one of said screed plates than the other screed plate, whereby said screed is selfpropelled in the direction of said closer screed plate.

9. A vibratory concrete screed according to claim 1 in which one of said screed plates includes a face concave in the direction of travel of said screed for grading and smoothing concrete.

10. A vibratory concrete screed according to claim 1 wherein said framework comprises at least a pair of separable, elongate frame units, and including means for releasably interconnecting adjacent end portions of adjacent frame units.

11. A vibratory concrete screed according to claim 10 in which said releasable interconnecting means includes adjustment means for varying the angular relationship between the screed plates of one frame unit relative to the screed plates of the adjacent frame unit.

12. A frame member for a vibratory concrete screed in which a plurality of said frame members are mounted in spaced relationship between a pair of spaced apart, elongate screed plates for working concrete as the screed is moved across the surface of the concrete, the frame member comprising (a) a unitary A-frame of triangular configuration, (b) a unitary cross support extending between adjacent sides of said A-frame, said cross support including a central aperture for attachment of vibratory means to impart uniform vibrations to the screed plates, and (c) a bracket at each corner of said A-frame for attachment of said frame members as an element of the concrete screed.

13. A frame member according to claim 12 in which each said bracket comprises opposed pairs of integral flanges extending laterally from said A-frame.

14. A frame member according to claim 12 in which said A-frame, said cross support and said brackets are a unitary casting of an alloy of aluminum and magnesium.

* * * * *